US005188422A

United States Patent [19]

Montgomery

[11] Patent Number: 5,188,422

[45] Date of Patent: Feb. 23, 1993

[54] FIELD SEAT

[76] Inventor: Roger L. Montgomery, 2817 Pleasant Dr., Pascagoula, Miss. 39567

[21] Appl. No.: 364,261

[22] Filed: Jun. 9, 1989

[51] Int. Cl.[5] ..... B60N 2/38

[52] U.S. Cl. ..... 297/195; 108/150; 248/155.2

[58] Field of Search ..... 297/195, 438, 439, 440; 108/150; 248/528, 533, 156, 434, 435, 316.5, 31.5, 228

[56] References Cited

U.S. PATENT DOCUMENTS

| | | | |
|---|---|---|---|
| 412,338 | 10/1889 | Hurlburt | 248/435 C |
| 934,676 | 9/1909 | Langslow | 248/231.5 |
| 1,089,295 | 3/1914 | Vallier | 248/155 X |
| 1,111,586 | 9/1914 | Hurlbert | 248/435 X |
| 1,209,679 | 12/1916 | Decker | 108/118 X |
| 1,764,071 | 6/1930 | Foulke | 248/231.5 X |
| 4,848,712 | 7/1989 | Russell | 248/155.2 |

FOREIGN PATENT DOCUMENTS

| | | | |
|---|---|---|---|
| 751986 | 9/1933 | France | 108/150 |
| 1158837 | 6/1958 | France | 248/156 |

*Primary Examiner*—José V. Chen

*Attorney, Agent, or Firm*—Alexander F. Norcross

[57] ABSTRACT

A portable, foldable camp or field seat, which may be folded to a size which can fit into a standard rear pocket. A base plate, having a footprint resistant to sinking in loose soil has, pivotally affixed, spaced apart wire frame seat supports which rise at an outward angle to support a cloth seat. The cloth seat is attached around the upper ends of the two foldable wire frame supports, forming the front and rear of the seat. The seat is used like a small saddle, sitting in a fore and aft direction. The weight of the body upon the cloth seat pulls the seat tight against the frame supports and forces the frame supports apart, pivotally around the base plate. This provides uniform support pressure for the seated individual without significant binding, pressure or discomfort from the frame supports. The base plate prevents sinking of the seat into the soil and provides for a low, squat position, particularly useful for hunters and the like. An alternative form of the seat is mounted on a support pole having a pointed tip for securing the pole against slipping in the soil. A ground support plate prevents the seat from sinking into the soil. This version provides a higher seated position where this is desirable.

4 Claims, 3 Drawing Sheets

FIELD SEAT

BACKGROUND OF THE INVENTION

This invention relates to the field of folding, portable chairs or seats.

U.S. Pat. No. 774,873 to Fuchs discloses an X-frame camp seat, with a fore and aft, crotch support seating. Fuchs discloses what may be described as a bicycle seat or saddle, having a broad rear section and a narrow frontal section. Further, Fuchs' seat is large, (note FIGS. 4–6) suspended from the body by straps. Fuchs is notable for using a particular bottom mounted spring (item 7) to force the seat apart into a fixed seating position as the seat is lowered to the ground.

U.S. Pat. No. 2,201,630 to Murtha discloses a cross frame or x-frame chair (called a Stick Chair) with two seat straps. A modified form of the chair pivots the sticks on a sliding member within a channel so that when closed the chair may be contained within the channel, and when open the channel serves as a third tripod leg.

U.S. Pat. No. 3,544,051 to Norman, disclosing a portable cane seat and gun rest, discloses a single point seat support. The structure does not utilize tension on the seat member for support but rather has a cross brace member (114), forming a solid triangular brace upon which the "saddle" is mounted.

U.S. Pat. No. 4,029,278, discloses a form of hunting stool in which a leveling leg is used to support the stool on uneven ground. Again, this leg provides the typical tripod support.

U.S. Pat. No. 4,328,992 to Ohanian discloses an adjustable x-frame stool which differs in that it has a gear revolving roller upon which the flexible seat material is rolled, and which may be set to varying degrees of extension, varying the height of the seat This illustrates that X-frame seats are not fully conformable, as the positioning of the legs on the ground determines the spacing of the seat supports.

U.S. Pat. No. 4,544,203 is a kind used by sunbathers. This is an x-frame headrest symmetrical, in the sense that it has cloth members on both the upper and lower surfaces, as support to prevent the headrest from sinking into the sand or ground. This patent notes the question of supporting the footing members of the seat against penetration into the ground. Norman's cane patent discloses a plate to prevent penetration into relatively soft terrain (item 28). This plate is, however, mounted well above the described foot and apparently is some form of a backup rather than being a regular ground foot.

SUMMARY OF THE INVENTION

The individual seat consists of a front support and a rear support of approximately equal size having a wider top section (approximately 6 to 7 inches) and a narrower base section (approximately 3 by 1 ½ inches). One such support is fixed to a foot section, a flat plate of approximately six square inches in surface, to which the other support (usually the rear) is hinged. Between the front and the rear supports is suspended a reinforced fabric. The general dimensions of the seat are that it is 6 to 7 inches wide at the seated position, each of the legs is approximately 7 inches long and the overall length of the seat fabric is approximately one feet long when opened.

The device is preferably used in conjunction with some form of back support. It is intended to provide a substitute for sitting on the ground in a hunting or field situation by providing a comfortable support for the seated individual a few inches from the ground. The position of such a seated individual is such that he is naturally in a normal seated shooting position. That is, the knees are raised in a position for the elbows to be rested on them in a natural shooting or firing position.

The seat is used in a position so it provides fore and aft crotch support. That support, in conjunction with the flexible, uniform width fabric of the seat face, provides or a uniform distribution of seating pressure across the bottom of the seated individual. There is absolutely no sensation of any hard surface pushing into the individual; merely a uniform support close to a ground seated position.

An alternative form of the invention, for use when the lower seating position is not preferred, supports the seat base plate upon an elongate support shaft, raising the height of the seat to a more usual 1 ½-3 feet above ground level. The body posture of the seated user is such that, when the seat is so raised, no back support is needed. No back support is needed in any case, if the user sits in a "squat" position with the feet in line with the center of gravity of the body, but this is not a usual posture for most Americans.

The seat as disclosed is extremely lightweight and small, measuring approximately 6"×7"×1 ½" folded, tapered to a 3" base. These dimensions are such that the unit, when folded, can easily be carried in a user's hip pocket. Weight is minimal, and the seat thus has a desirable combination of lightness and compactness, essential in Field gear for hunting or camping use.

It is thus an object of the invention to disclose a field or camping seat construction which has desirable lightness and portability characteristics.

It is a further object of the invention to provide a portable seat particularly suited to hunting, where a low seated posture is desirable.

It is a further object of the invention to disclose a portable hunting seat that is particularly comfortable for periods of long use where body movements must be minimized.

It is a further object of the invention to disclose a collapsible, or foldable seat which adapts to the weight and size of the user, minimizing uneven seat pressure and discomfort.

These and other objects of the invention will be more apparent from the detailed description of the preferred embodiment which follows.

DETAILED DESCRIPTION OF THE PREFERRED EMBODIMENT

Figure 1:
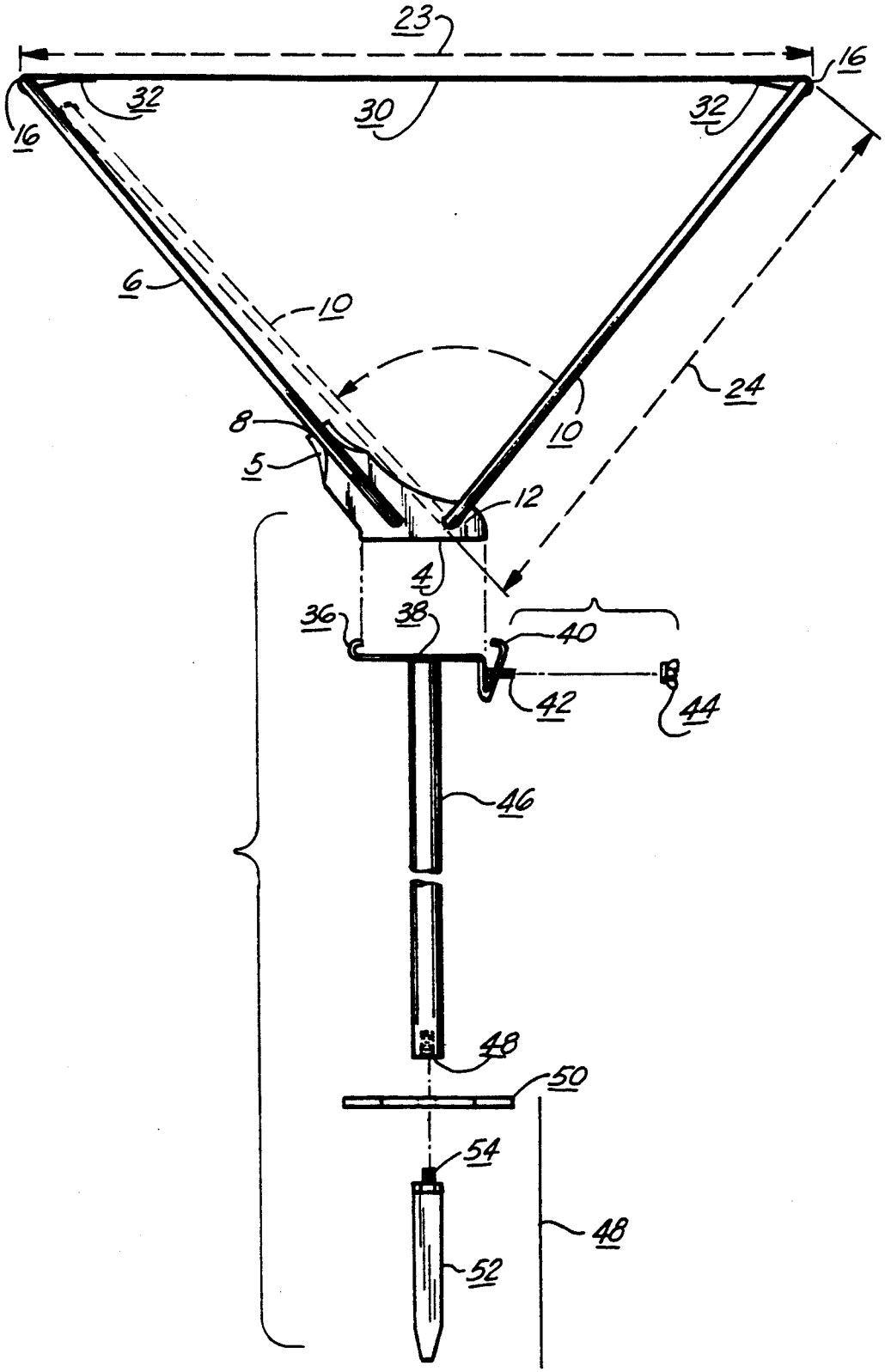
FIG. 1 is an exploded view of the invention in side profile.
Figure 2:
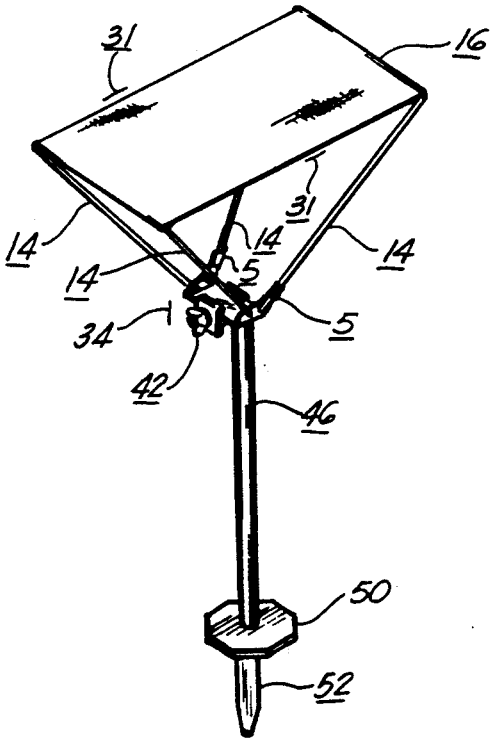
FIG. 2 is an angled view of the invention as assembled.
Figure 7:
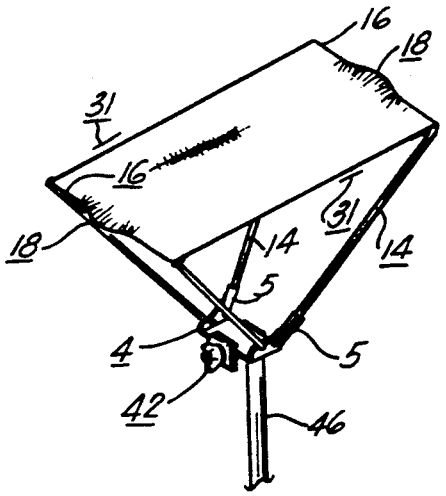
FIG. 7 is a view of an alternate embodiment of the invention.
Figure 3:
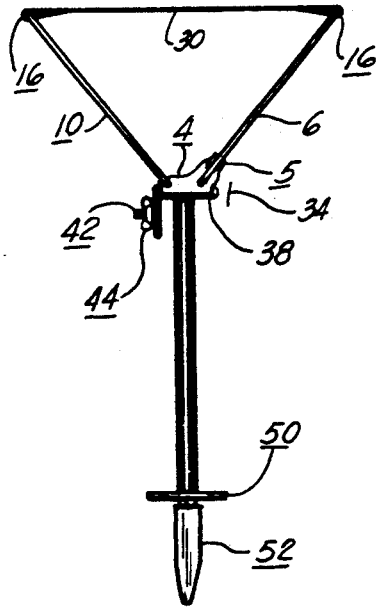
FIG. 3 is a side view of the invention.
Figure 4:
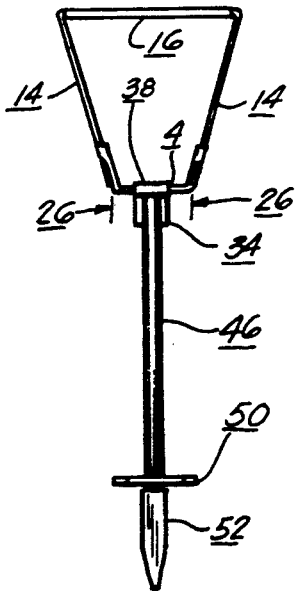
FIG. 4 is an end view of the invention.

Referring specifically to FIG. 1, the seat 2 of the invention is seen to be mounted from a first base plate 4, a substantially strong metal plate, capable of supporting the weight of an individual and the seat without significant flexure or bending. In the preferred embodiment, the base plate 4 is made of a piece of steel, suitably protected against corrosion by paint and having dimensions of approximately 3 ½" lengths by 1 ½" width. Preferably, the base by folding, in a shallow U-channel, a flat plate of steel, the upright members of the U-channel forming the narrow ends of the plate. Within these ends are provided two parallel holes for receiving first frame support 6 and second frame support 10.

In this form of construction a base plate support lip 5 is provided for fixedly capturing and holding first frame support 6 in a fixed position. This can be easily done by forming an elongated U-channel in the sides of lip 5.

Alternatively, first frame support 6 can be fixedly affixed to base plate 4 at first frame support attachment point 8. Second frame support 10 would be pivotally attached to the base plate 4 at second frame support point 12. In the preferred embodiment of the invention first frame support 6 and second frame support 10 are affixed by pivotally insertion of bent ends of the frame supports 6, 10 through provided holes in the base plate 4, but any form of pivotal attachment would be suitable as described below.

Each of first frame support 6 or second frame support 10 are formed identically, preferably from a continuously formed piece of high tensile strength steel wire or rod bent in the form of a trapezoid, the wider side of which forms a flat wire top member 16 extending downward along converging wire sides 14, terminating at base plate 4 at a narrower side or base. The width 22 of the wire top 16 should be substantially equal to the length 24 of the wire sides 14, but should be substantially twice as great as the width 26 of the base, between the wire pivot, tips 20.

Each of the frame supports is pivotally affixed to the base plate 4, or, for the affixed first frame support 6, welded to base plate 4 or latched into the receiving lip 5.

Affixed between the two wire tops 16 of the frame support is seat member 30.

Seat member 30 is substantially rectangular in shape, and is preferably an open mesh, relatively strong cloth seat material, having a coarse weave and a degree of porosity. This has been found to be the most comfortable seating material, because of its ventilating effect for long term usage.

However, it has been found that for reasons of attractiveness, customer acceptance is greater with a closed weave, padded, camouflaged pattern cloth seat member 30. This is true even though it is the opinion of the inventor that the open weave cloth seat is a more comfortable version. However formed, cloth seat 30 is an essentially rectangular cloth member fixedly attached and suspended between the two wire tops 16, preferably by being sewn over the edges along reinforced seams 32 at each end. The cloth seat 30 is completely flexible and folds and bends, responsive to the relative folding of second frame support 10 towards first frame support 6.

It has been found that a useful variation may be obtained by providing outwardly extending bulges or curves in each of the wire top 16 of first frame support 6 and second frame support 10, the outward bulges or bends 18 being opposed to each other. As a result, cloth seat 30 remains of a substantially rectangular aspect save that the short sides thereof, the sides affixed to wire tops 16, are curved outwardly one from another so that cloth seat 30 is somewhat longer between the midpoints of its shorter sides, the midpoints corresponding to the frame bends 18, then along the long edges or long sides 31 of the seat.

Optionally, as a means of raising the overall height of the seat 2, a seat support member is formed and attached through a base plate support clamp 34 to base plate 4.

Base plate support clamp 34 consists of a planar support base 38, for pressure enclosure and support of base plate 4. At one edge of support base 38 is fixed receiving notch 36 for enclosing, grasping of a wide edge of base support plate 4. Along a corresponding edge of base plate support clamp 34, corresponding to the second parallel wide edge of base plate 4, is a movable clamp member 40, adapted to enclose, by grasping, base plate 4 in cooperation with fixed receiving clamp 36, when movable clamp 40 is tightened against the base plate support 34 by interconnection of clamp tightening screw 42 and clamp tightening nut 44. For ease of use, clamp tightening nut 44 is a wing nut, and preferably movable clamp 40 is a separate metal clamping piece affixed to the base plate support 34 solely by means of clamp tightening screw 42.

Base support plate 34 forms an upper end of and is affixed to a base support shaft 46, preferably by welding or similar fastening. Base support shaft 46 is a vertical shaft preferably of approximately one and a half to three feet in length. At an end 46 of base support shaft 48, distal of base plate support 34, is ground support receiving means 48. This is an adapter preferably an inwardly extending threaded socket.

A suitable ground support means comprises a ground support plate 50, a round or pentagonal flat steel plate, of a size sufficient to support the weight of seat and user against sinking into soft or noncompacted soil and having a central hole through the plate through which passes stabilizing blade attachment screw means 54, adapted to interconnect by screwing into threaded socket 48 for attaching stabilizer blunt spike 52. Stabilizer blunt spike 52 is a pointed angled steel blade adapted for penetration into the ground, sufficient to prevent lateral movement of the stabilizer blunt spike 52 and thus the seat 2 during use.

In use, seat 2 may be used alone or with the base support shaft 46.

Figure 5:
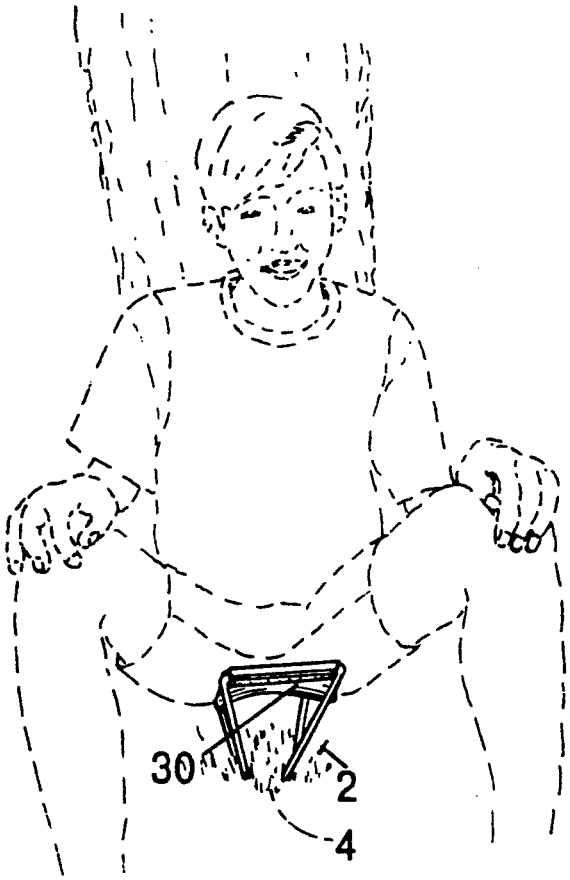
FIG. 5 is a view of the invention in use in the lower, squat seated position.
Figure 6:
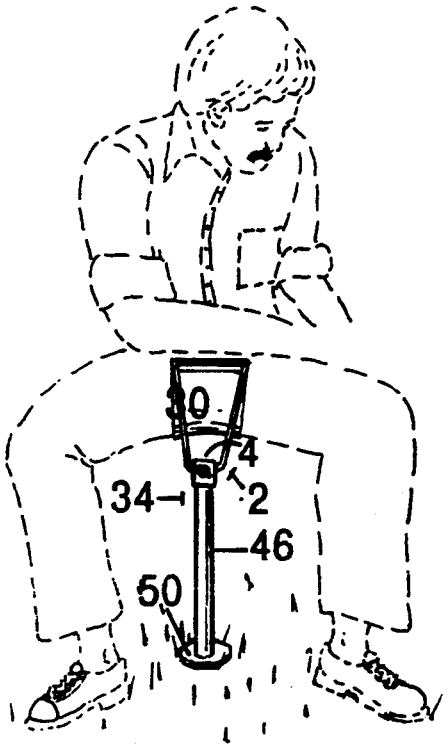
FIG. 6 is a view of the invention in the higher, pole supported seated position.

Seat 2 is of particular utility when used alone for hunting and the like, where a low profile is desired to be maintained but where sitting on unprotected ground becomes uncomfortable over time due to moisture. Seat 2 is of particular utility for maintaining a low profile seated position in comfort, a spaced distance from the ground. As depicted in FIG. 5, seat 2 is oriented in a fore and aft position, one frame support in the front of the seated individual and the other frame support behind the seated individual. The tapered shape of the frame supports 6, 10 being of a greater width 22 at the tops 16 thereof and the length of the seat 23 being substantially greater than the width of the base 26, the weight of an individual against the seat 30 forces the frame supports 6,10 outward, apart from each other, pivoting around second frame support attachment point 12. It is to be recalled that normally, in the preferred version, it is found most successful for the first frame attachment point 8 to be affixed to the base; the base plate 4 thus pivots with the first frame support 6.

The overall size of base plate 4 may be increased as needed, but for an average user approximately five square inches of surface provides a sufficient contact area with the soil so as to prevent seat 2 from sinking into soil.

Preferably, the seat 2 is positioned next to a back support such as a tree, and serves to support the seat of the user a short distance off the ground, the user's back support being leaning back against a tree.

The substantial angle of divergence of the first frame support 6 and the second frame support 10 between the wire tops 16 and the pivot tips 20, cause the seating effect upon the frame supports to be as though the user was seated on a side of the frame supports pushing them away. There is substantially no feeling of sitting on a hard object. For extended use, this divergent effect may be increased by providing a fit bend 18 within frame supports, to reduce contact between the user's body and the frame supports.

The free pivoting of at least second frame support 10 against base plate 4 tensions seat 30 against the bottom of the user, providing for a uniform seating pressure across the crotch and an extreme degree of comfort during extended seated sessions. Thus use, for example, for turkey hunting or still hunting, where extending periods of no movement are required to avoid spooking game, become both practicable and comfortable with the seat 2.

Although the squat position previously described is particularly advantageous in hunting, and may be a more natural seated position to the human frame, at least in western society the accustomed sitting posture is with the seat of the user being supported a greater distance above the ground. Thus, when seat 2 is in use as a sports or spectator seat or as a field seat, base plate 4 is elevated by an elongate base support shaft 46 by interconnection of base plate support clamp 34, clamping support base 38 against base plate 4 between fixed clamp 36 and movable clamp 40.

The seat 2, so clamped to support shaft 46 is a structure of some one and a half to three feet in height. The functioning of the seat 30, its comfortable support, and the lack of irritating pressure points remains the same. However, the entire seat 2 is elevated above ground level by the overall length of the provided base support shaft 46, providing a more elevated seat as would be desirable for spectators, sporting usage and the like.

At the bottom of base support shaft 46, a ground support plate 50 prevents shaft 46 from sinking into the ground even though the ground may be loose, moist or noncompacted. At the same time, a penetrating blunt spike 52 at the bottom tip end of base support shaft 46 provides for a positive engagement of the seat 2 with the ground, minimizing slippage and similar discomfort as might otherwise be encountered with a single point support seat in loose ground.

A particular advantage of the construction for the seat 2 given is that, the first frame support 6 and the second frame support 10 being made substantially of a lightweight but strong spring wire rod structure, foldable against each other, the entire structure may be readily folded and placed in a hip pocket for ease of carriage. Only when it is desired to utilize a base support shaft 46 is it necessary to carry an object of any size greater than can be conveniently placed in the pocket of a user, and the base support shaft 46, disassembled from and carried loose with the ground support plate 50 and the stabilizer blunt spike 52 is easily packed and carried as a small object.

The seat thus is of a particularly compact size for a hunter going into the field and adds very little to the hunter's weight and burden of carriage; nonetheless, it provides an extreme increase in comfort for long, fixed seating hunting positions in field hunting.

While the depiction given is of an embodiment considered by the inventor to be particularly efficient in manufacture and in use, it should be apparent that there are a wide range of possible embodiments for the pivoting of frame support members against the base plate, maintaining only the geometry of a narrow base and a widely diverged top, tensioning between the two top supports an elongate rectangular cloth seat member to provide for a comfortable seat. The invention, therefore, extends to that wider range of equivalents as are claimed.

I claim:

1. A portable seat comprising:

a base plate member having a supporting area for ground support of a seat;

a first and a second vertically arising frame support member, each affixed to said base plate member;

a first such frame support member being angularly affixed to said base plate member;

the second said frame support member being pivotally affixed, free to pivot with respect to first said frame support member;

a substantially rectangular flexible seat member attached along a top end of the first said frame support member, extending to and attached along a top end of the second said frame support member, distal said base plate member;

said frame support members defining a front and a rear of said seat member;

said seat member being of a modified rectangular configuration, having two elongate parallel non-supported sides;

being attached along two, shorter supported sides; said supported sides defining the shape of the top end of the frame support members;

the supported sides curvingly diverging from each other, defining thereby an outwardly extending portion around a mid point of the top end of each frame support member.

2. A portable seat comprising:

a base plate member having a supporting area for ground support of a seat;

a first and a second vertically arising frame support member, each affixed to said base plate member;

a first such frame support member being angularly affixed to said base plate member;

the second said frame support member being pivotally affixed, free to pivot with respect to first said frame support member;

said frame support members defining a front and a rear of said seat;

a substantially rectangular cloth member attached along a top end of the first said frame support member, extending to and attached along a top end of the second said frame support member, distal said base plate member;

means for affixing a removable vertical support shaft to said base plate member;

means for supporting said vertical support shaft fixedly against the ground;

said cloth member being of a modified rectangular configuration, having two elongate parallel nonsupported sides;

being attached along two, shorter supported sides; the supported sides curvingly diverging from each other, defining thereby an outwardly extending portion at a mid point of each said supported side of said cloth member.

3. A portable seat comprising:

a base plate member having a supporting area for ground support of a seat;

a first and a second vertically arising frame support member, each affixed to said base plate member;

a first such frame support member being angularly affixed to said base plate member;

the second said frame support member being pivotally affixed, free to pivot with respect to first said frame support member;

a substantially rectangular flexible seat member attached along a top end of the first said frame support member, extending to and attached along a top end of the second said frame support member, distal said base plate member;

said frame support members defining a front and a rear of said seat member;

wherein said frame support members further comprise:

a substantially strong, spring wire frame having a horizontal top section thereof;

said wire frame descending forward from said top section along two, coplanar, converging side wire sections;

each side wire section pivotally affixed to said base plate;

said wire frame forming with said base plate a trapezoidal shape;

said seat member being of a modified rectangular configuration, having two elongate parallel nonsupported sides;

having two, shorter supported sides attached along said horizontal top section;

each said horizontal top section being curved outwardly with respect to the seat member;

the supported sides thereby curvingly diverging from each other, whereby the seat member is somewhat longer between midpoints of its shorter, supported sides than along its elongate nonsupported sides.

4. A portable seat comprising:

a base plate member having a supporting area for ground support of a seat;

a first and second vertically arising frame support member, each affixed to said base plate member;

a first such frame support member being angularly affixed to said base plate member;

the second said frame support member being pivotally affixed, free to pivot with respect to first said frame support member;

said frame support members defining a front and a rear of said seat;

a substantially rectangular seat member attached along a top end of the first said frame support member, extending to and attached along a top end of the second said frame support member, distal said base plate member;

means for affixing a removable vertical support shaft to said base plate member;

means for supporting said vertical support shaft fixedly against the ground;

said seat member being of a modified rectangular configuration, having two elongate parallel nonsupported sides;

having two, shorter supported sides attached along said top ends of said frame support members;

each said top end of said frame support members being curved outwardly with respect to the seat member;

the supported sides thereby curvingly diverging from each other, whereby the seat member is somewhat longer between midpoints of its shorter, supported sides than along its elongate nonsupported sides.

* * * * *